United States Patent [19]

Hoeberechts et al.

[11] Patent Number: 4,853,585

[45] Date of Patent: Aug. 1, 1989

[54] DISPLAY DEVICE WITH MULTIPLICITY OF CLOSELY SPACED ELECTRON BEAMS

[75] Inventors: Arthur M. E. Hoeberechts; Gerardus G. P. Van Gorkom, both of Eindhoven, Netherlands

[73] Assignee: U.S. Philips Corporation, New York, N.Y.

[21] Appl. No.: 156,491

[22] Filed: Feb. 16, 1988

[30] Foreign Application Priority Data

Feb. 27, 1987 [NL] Netherlands ..... 8700486

[51] Int. Cl.[4] ..... H01J 29/51; H01J 29/62; H01J 29/74

[52] U.S. Cl. ..... 313/422; 313/424; 313/426; 313/449; 313/497

[58] Field of Search ..... 313/422, 446, 495, 414, 313/424, 426, 427, 432, 439, 449, 497

[56] References Cited

U.S. PATENT DOCUMENTS

| | | | |
|---|---|---|---|
| 4,028,582 | 6/1977 | Anderson et al. | 313/422 |
| 4,205,252 | 5/1980 | Sinclair et al. | 313/422 |
| 4,303,930 | 12/1981 | Van Gorkom et al. | 357/13 X |
| 4,554,564 | 11/1985 | Van Gorkom et al. | 313/422 X |

*Primary Examiner*—Kenneth Wieder
*Attorney, Agent, or Firm*—Robert J. Kraus

[57] ABSTRACT

A flat thin display device is obtained by means of cold cathodes (10) in which each cathode provides the electron emission (14) for a (part of a) column of pixels. The emissive surface is preferably chosen to be parallel to the front and rear walls (3, 4) of the display device so that the cathodes cannot degrade due to an ion bombardment.

11 Claims, 1 Drawing Sheet

DISPLAY DEVICE WITH MULTIPLICITY OF CLOSELY SPACED ELECTRON BEAMS

BACKGROUND OF THE INVENTION

The invention relates to a display device provided with a substantially evacuated envelope having mainly flat substantially parallel front and rear walls, a layer of luminescent material along the inner surface of the front wall and means for generating a plurality of electron beams which move substantially in a plane parallel to the front and rear walls and can be selectively deflected via deflection means in the direction of the layer of luminescent materials so that each beam scans at least a part of the layer of luminescent material.

A display device of this type has great advantages because thin, flat television screens can be realized therewith. For these devices research is being done to find such constructions that the use of thick glass walls, which is often necessary in connection with the high vacuum, can be avoided as much as possible. Other points of consideration are a uniform brightness throughtout the picture surface independent of the pixel driven and the possibility of integration with control electronics.

A display device of the type described in the opening paragraph is known from Netherlands Patent Application No. 7610521 laid open to public inspection, and corresponding to U.S. Pat. No. 4,028,582.

In this device electron beams are guided through channels and are subsequently not only deflected towards the phosphor screen, but the beams also perform a scanning movement in the transversal direction of the channel. This movement is carried out to simplify the electron gun for such a device.

The description of the electron gun in the patent application is limited. It is stated that only either one single source for one beam or a line cathode are arranged on and alongside the end walls of the channels, respectively.

The dimensions of conventional cathodes are such that electron beams generated from two cathodes located at a minimum distance from each other include a plurality of columns of pixels so that a horizontal deflection across a plurality of pixels is required in this case. Moreover the energy supplied is so high that such a solution is extremely costly for reasons of energy considerations and extra material costs (horizontal deflection electrodes in the channels).

SUMMARY OF THE INVENTION

A display device according to the invention is characterized in that the means for generating the electron beams comprise at least a semiconductor body having one or more semiconductor cathodes on a main surface, which cathodes can be separately driven, and in that the device comprises at least one cathode for each vertical column of pixels.

The invention is based on the recognition that the emissive regions which can be separately driven can be realized at such a small distance from each other in semiconductor cathodes that the channels as described in the Netherlands Patent Application No. 7610521 laid open to public inspection can be dispensed with because deflection in the transversal direction across a plurality of pixels, or (in the case of color display) parts of pixels is not necessary.

In this case it is not strictly necessary for the emissive surface to coincide with the main surface of the semiconductor body. For example, the cathode may be formed from one or more punctiform emitters as described in Netherlands Patent Application NL No. 7905470 laid open to public inspection, and corresponding to U.S. Pat. No. 4,303,930.

The use of semiconductor cathodes in various display devices has already been proposed, notably in Netherlands Patent Application No. 7905470 in the name of the Applicant. However, such cathodes have the drawback that, although they amply comply with the imposed requirements as regards dimensions when used in a device according to NL No. 7610521, their efficiency decreases rapidly due to an ion bombardment which is caused by positive ions created in notably the high-tension part of the device.

To prevent this a preferred embodiment of a display device according to the invention is characterized in that the main surface of the semiconductor body extends substantially parallel to the plane in which the electron beams move.

A display device of this type can generate electron beams which are subsequently deflected through 90° by means of an electron-optical system. After the beams have been deflected, the electrons are accelerated by, inter alia the high-voltage electrons. Ions generated by collisions of electrons with atoms of residual gases are therefore mainly accelerated in the plane of the beams which is parallel to the semiconductor surface and do not impinge upon this semiconductor surface. Besides, the use of semiconductor cathodes provides a very good possibility of controlling the emission of each semiconductor cathode separately so that a uniform emission for the different cathodes and therefore a uniform luminescence of the phosphor screen is obtained. In addition, in one embodiment the electron beam twice makes a bend through 90° but in the opposite sense of rotation, thus largely preventing astigmatism in the electron beam. In another embodiment the electron beam makes a bend twice through approximately 90° in the same sense of rotation so that a display device can be manufactured with a completely flat glass face plate and a metal cover which together with the glass plate defines an evacuated space. The extra introduced astigmatism can be eliminated with means which are generally known such as, for example a four-pole field.

The deflection through 90° may be effected over a very short distance (for example 4 mm). The electron-optical system required for this purpose can be manufactured by means of a method as described in the simultaneously filed U.S. Application No. 156,376.

However, deviations due to the earth's magnetic field which in conventional systems would be largely corrected by means of the accelerating electrodes must now be avoided in another way.

To this end the plane within which the electron beams move parallel to the front wall and the rear wall is substantially entirely surrounded by a magnetic shield whose outer cladding may also function as a high-voltage electrode.

For connecting the cathodes in the first embodiment the semiconductor bodies may be directly mounted on the rear wall (in this case an insulative, for example glass, rear wall) with connection tracks extending outside the envelope.

However, the semiconductor bodies are preferably provided on a separate support having connection tracks, with the support and the connection tracks extending outside the envelope.

Control circuits can then be mounted on the part of the support located outside the envelope by means of, for example chip-on glass technology or flip-flop technology. Such a structure is logistically advantageous because the support with the control circuits and the cathodes can be tested before they are finished and can subsequently be stored temporarily, if necessary, whilst the envelope and the rear wall can be separately manufactured and stored.

There are various possibilities for the display device after deflecting the electron beam from the plane parallel to the front and rear walls.

A choice can be made for the so-called penetration principle (for example in the case of two colors) in which the voltage on the front wall is changed dependent on the color to be displayed. The so-called index principle may be used alternatively.

Preferably, however, the display device has a shadow mask (which may be provided with deflection electrodes). The shadow mask may form part of the magnetic shield mentioned hereinbefore. For the display of a picture two (monochrome) or six (color) line memories are required in this case for displaying the previous picture and storing the next (sub) picture, respectively.

A light-valve may be placed in front of the face plate, for example a liquid crystal device which successively passes the red, green and blue sub-pictures. In that case the device should have picture memories.

BRIEF DESCRIPTION OF THE DRAWING

The invention will now be described in greater detail, by way of example with reference to the accompanying drawing figures in which.

The drawings are not to scale; corresponding components generally have the same reference numerals.

DESCRIPTION OF THE PREFERRED EMBODIMENTS

Figure 1:
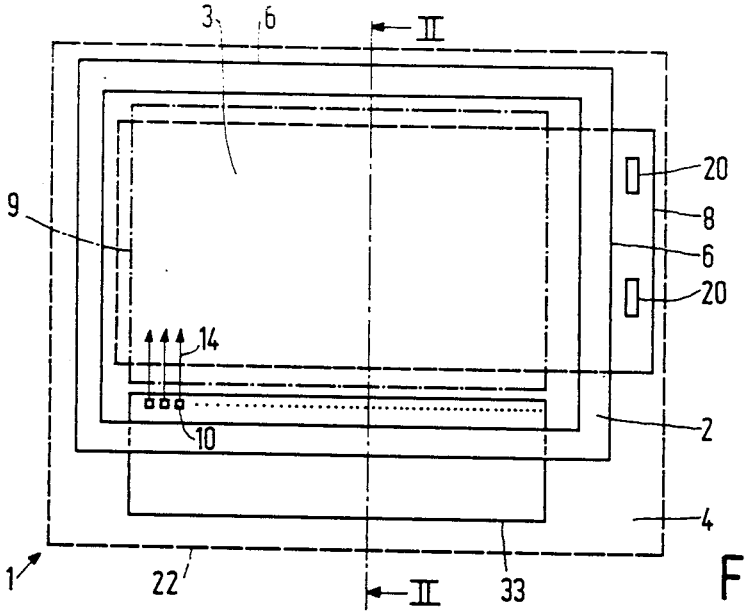
FIG. 1 is a diagrammatic front view of a first embodiment of a display device according to the invention.
Figure 2:
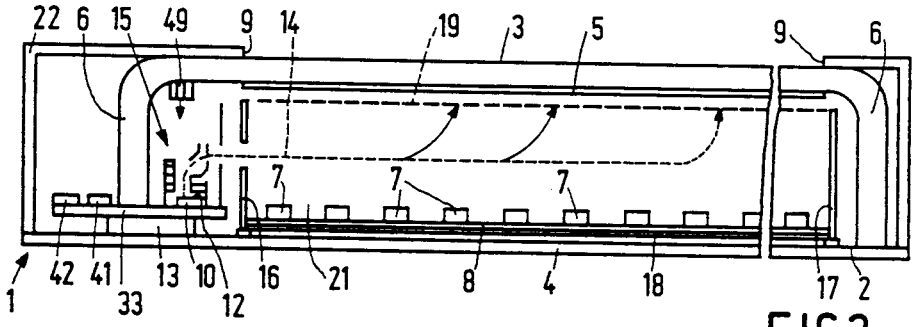
FIG. 2 is a diagrammatic cross-section taken on the line II—II in FIG. 1.

FIG. 1 is a diagrammatic plan view and FIG. 2 is a cross-section of a display device 1 according to the invention, provided with a substantially evacuated envelope having a front wall 3 and a rear wall 4. Together with the side walls 6, the front wall 3 forms part of a glass cover or tub having an overall height of, for example 5 cm, whilst the rear wall 4 in this embodiment is in the form of a thin steel wall which may have reinforcing ribs. A layer of luminescent material, for example a phosphor screen 5 is provided along the inside of the front wall 3.

The display device 1 also has means for generating a plurality of electron beams 14 which move at least substantially in a plane parallel to the front wall 3 and the rear wall 4 before they are deflected in the direction of the phosphor screen 5. The electron beams move not only parallel to the front wall 3 and the rear wall 4 but also substantially perpendicularly to the picture lines of the picture to be displayed; this is notably the case if, as in the present embodiment, at least one electron beam is available for each pixel column. The phosphor parts to be impinged on (in other words the picture line to be activated) are (is) selected via voltages at deflection electrodes 7 arranged in this embodiment on an insulative support 8. The electron beams 14 are deflected thereby towards the phosphor screen 5.

According to the invention the electron beams 14 are generated by means of semiconductor cathodes 10 which may be separately driven, whilst the emissive surface 12 in this embodiment extends parallel to the walls 3, 4. The generated electron beams 14 are deflected through an angle of 90° within a distance of less than 1 to 2 cm by means of a special electron-optical system 15 whose structure and method of manufacture is described in greater detail in the simultaneously filed U.S. application Ser. No. 156,376.

The deflected electrons are subsequently accelerated in a direction parallel to the walls 3, 4 by grids of the high-voltage part 21. Possible positive ions which are then generated will also move parallel to these walls, in the opposite direction, and cannot impinge upon the emissive surface due to the large mass difference with respect to the electrons.

After the electrons have been accelerated as far as the high-voltage region 21, they are deflected towards the phosphor screen 5 so that each electron beam twice makes a bend of approximately 90°. Since the one bend, viewed from the side turns to the left and the other turns to the right, astigmatism is largely obviated, which from an electron-optical point of view is favorable.

For each pixel column to be displayed the display device 1 comprises at least one cathode 10 which is provided with the correct voltages for obtaining the desired electron emission by means of a control unit 41 which is diagrammatically shown and which in turn is controlled by a circuit 42. Such a control per pixel column is possible because semiconductor cathodes are used on the one hand, which makes the use of separate very small cathodes with a mutual distance of not more than 1 mm possible, and on the other hand it is possible to adapt the electron-optical system 15 thereto as described in U.S. application Ser. No. 156,376.

The assembly of cathodes and other components may be secured to the rear wall 4 with the different parts being interconnected via metal tracks, whilst the rear wall 4 is made of, for example, glass.

Since there is substantially a vacuum in the interior of the device, large forces are exerted on the glass walls so that these walls must be relatively thick; this makes the assembly very thick and consequently heavy for practical use. For this reason a metal (for example steel) rear wall 4 is preferably chosen and the control circuits 41, 42 and the connections of the electron-optical system 15 are provided on a separate support 33 (FIG. 2) which may be supported by an intermediate piece 13.

The electrons of the beams 14 are accelerated parallel to the front and rear walls before they reach the actual display region 9. These electrons may deviate from their straight path under the influence of the earth magnetic field, whilst a lateral correction therefor is not possible. Therefore the plane within which the electrons are accelerated and move parallel to the front and rear walls is substantially entirely surrounded by a magnetic shield, in this embodiment having a cage-like construction comprising, for example, the support 8 of the electrodes 7 and which for this purpose is provided on its lower side with a metal layer or pattern 18, whilst the device has an electrically conducting bush connected thereto with a first wall 16 (also acting as a high-voltage grid) and an end wall 17, the assembly being magnetically closed by the shadow mask 19. Other, more open constructions are alternatively possible in which, if necessary, generally known methods of demagnetizing can be used as in this embodiment. The electrodes 7 can be controlled via control circuits 20 which are also provided on the support 8 in this embodiment and which are contacted by means of metal tracks (not shown) projecting outside the side wall 6.

The device may have a cesium source 49 facing the cathode in order to provide for the supply of cesium (or another work-function decreasing material) to the cathode surface.

The envelope defining the vacuum space can be built in a protective cabinet 22 which leaves open the visible part of the picture and which may accommodate operating elements.

As described in the opening paragraph there are various possibilities for the display of the picture after the electron beam 14 has been deflected to the phosphor screen 5. In the case of colour display use can be made of, for example the penetration principle, notably for use in display tubes having not more than two colors, or the so-called index principle may be used.

In the device shown the phosphor screen 5 is divided, for example, into horizontal strips of three differently-external (R,G and B) luminescent materials. The information for each of the three colours is presented during ⅓ of the line period whereafter the voltages at the deflection electrodes are slightly changed and the information for the adjacent colour track is presented during ⅓ of the line period, etc. Since in TV-display the (color) information is simultaneously read and is presented in accordance with the incoming signal, the colour information is stored temporarily in line memories. Each colour to be displayed requires two line memories, namely one for the line which is read and a second in which the next line is stored.

It is alternatively possible to use so-called light-valves in which each time during ⅓ part of the picture period a monochrome tube is driven with the red, green and blue picture signals, respectively, whilst light-valves present in front of the tube, for example LCD's with red, green or blue colour filters are switched on synchronously. In this case the use of picture memories is required.

Figure 3:
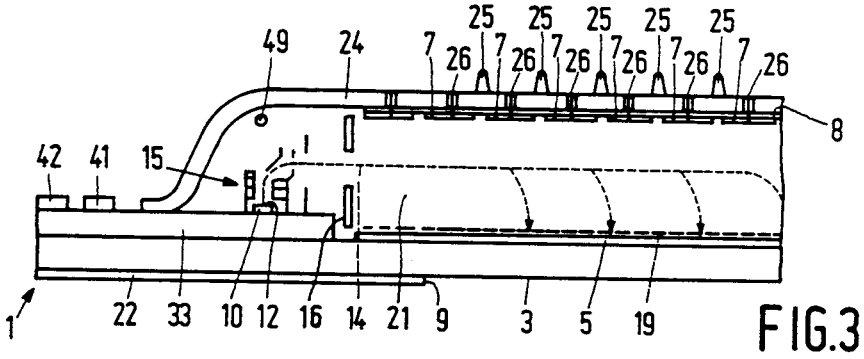
FIG. 3 shows diagrammatically a second embodiment of a device according to the invention.

The variant of FIG. 3 shows a display device 1 with a flat front wall 2 on which a phosphor screen 5 is provided. The device also comprises for each pixel column one or more cathodes 10 which are provided via a control unit 41 and a circuit 42 with the correct voltage in order to obtain the desired emission.

The electron beams 14 generated in the cathodes 10 are again deflected through 90° by the electron-optical system 15 and subsequently accelerated. The vacuum space is now constituted by the glass wall 3 and a cover or tub of a soft-magnetic material 24 which are fixed together in a vacuum-tight manner. Between the tub 24 which is also provided with cooling fins 25, there is provided at one end a support 33 for the cathodes 10, the electron-optical system 15 and the auxiliary electronic circuits 41, 42. The electron beam 14 is deflected in the display part 9 by means of voltages at the deflection electrodes 7. The deflection electrodes 7 are arranged, for example on a glass support 8 and may be supplied with the correct voltage via leadthroughs 26. Otherwise the reference numerals have the same significance as those in FIG. 2.

The invention is of course not limited to the embodiments described, but several variations are possible within the scope of the invention. For example, as already stated, a plurality of cathodes may be used per picture column. Several choices are also possible for the semiconductor cathodes, for example the cathodes as described in U.S. Pat. Nos. 4,516,146; 4,506,284 and in Netherlands Patent Applications Nos. 8,600,675 and 8,600,676.

What is claimed is:

1. A display device including an envelope having substantially flat front and rear walls, a luminescent screen on an inner surface of one of said walls and means for producing at least one electron beam directed to the screen, characterized in that said display device comprises:

a. an electron beam source comprising a multiplicity of semiconductor cathodes arranged for emitting respective electron beams in a first predetermined direction along paths lying in a first plane;

b. first deflection means for deflecting the emitted electron beams to respective paths in a second predetermined direction transverse to the first predetermined direction and lying in a second plane;

c. accelerating means for producing an acceleration field which accelerates the electron beams along their respective paths in the second predetermined direction, said field accelerating any positive ions occurring therein in a direction opposite to said second predetermined direction along respective paths which do not lead to said cathodes; and d. second deflection means for deflecting the accelerated electron beams toward the screen.

2. A display device including an envelope having substantially flat, parallel front and rear walls, a luminescent screen on an inner surface of the front wall, and means for producing a multiplicity of electron beams directed to the screen to effect production of a multiplicity of columns of pixels, characterized in that said display device comprises:

a. a semiconductor body comprising a multiplicity of semiconductor cathodes arranged in a row for emitting said multiplicity of electron beams in a first predetermined direction along paths lying in a first plane;

b. first deflection means for deflecting the emitted electron beams to respective paths in a second predetermined direction transverse to the first predetermined direction and lying in a second plane;

c. accelerating means for producing an acceleration field which accelerates the electron beams along their respective paths in the second predetermined direction, said field accelerating any positive ions occurring therein in a direction opposite to said second predetermined direction along respective paths which do not lead to said cathodes; and d. second deflection means for successively deflecting the accelerated electron beams toward the screen at different rows of said pixels.

3. A display device as in claim 1 or 2 where the first predetermined direction is perpendicular to the screen, and where the second predetermined direction is parallel to said screen.

4. A display device as in claim 1 or 2 where the first deflection means effects bending of the emitted electron beams through a first angle of rotation, and where the second deflection means effects bending of the accelerated electrons through a second angle of rotation which is equal in magnitude but in the opposite direction of rotation with respect to the first angle.

5. A display device as in claim 4 where the magnitude of each of said angles is approximately ninety degrees.

6. A display device as in claim 5 where the rear wall supports the second deflection means, and where the front wall is part of a transparent tub-shaped body which cooperates with the rear wall to form the envelope.

7. A display device as in claim 1 or 2 where the first deflection means effects bending of the emitted electron beams through a first angle of rotation, and where the second deflection means effects bending of the accelerated electrons through a second angle of rotation which is equal in magnitude and in the same direction of rotation with respect to the first angle.

8. A display device as in claim 7 where the rear wall supports the second deflection means and forms part of a tub-shaped body which cooperates with the front wall to form the envelope, and where the front wall is transparent.

9. A display device as in claim 1 or 2 where the rear wall consists essentially of a soft magnetic material.

10. A display device as in claim 9 where the rear wall consists essentially of steel.

11. A display device as in claim 1 or 2 where said device includes shielding means for shielding the paths which the electron beams follow in the second predetermined direction from magnetic fields external of the envelope.

* * * * *